US010308010B2

(12) United States Patent
Boland et al.

(10) Patent No.: US 10,308,010 B2
(45) Date of Patent: Jun. 4, 2019

(54) INFRARED-HEATED AIR KNIVES FOR DRYERS

(71) Applicants: Stuart James Boland, Denver, CO (US); Graham James Carson, Boulder, CO (US); Scott Richard Johnson, Erie, CO (US)

(72) Inventors: Stuart James Boland, Denver, CO (US); Graham James Carson, Boulder, CO (US); Scott Richard Johnson, Erie, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/427,297

(22) Filed: Feb. 8, 2017

(65) Prior Publication Data

US 2018/0222178 A1 Aug. 9, 2018

(51) Int. Cl.

| | |
|---|---|
| ***B41F 23/04*** | (2006.01) |
| ***F26B 3/28*** | (2006.01) |
| ***F26B 21/00*** | (2006.01) |
| ***F26B 23/04*** | (2006.01) |
| ***B41J 11/00*** | (2006.01) |
| *F26B 13/00* | (2006.01) |

(52) U.S. Cl.

CPC ..... *B41F 23/0413* (2013.01); *B41F 23/0436* (2013.01); *B41J 11/002* (2013.01); *F26B 3/283* (2013.01); *F26B 21/004* (2013.01); *F26B 23/04* (2013.01); *F26B 13/00* (2013.01)

(58) Field of Classification Search

CPC ..... B41F 23/0413

USPC ..... 101/424.1

See application file for complete search history.

(56) References Cited

U.S. PATENT DOCUMENTS 2,889,806 A * 6/1959 Conant ..... B32B 27/00 118/643

3,720,002 A * 3/1973 Martin ..... D06C 7/00 34/421

(Continued)

FOREIGN PATENT DOCUMENTS

DE 19929273 A1 12/2000

DE 102012019744 A1 4/2014

(Continued)

OTHER PUBLICATIONS

DE102012019744 English Abstract.

(Continued)

*Primary Examiner* — Anthony H Nguyen

(74) *Attorney, Agent, or Firm* — Duft & Bornsen, PC

(57) ABSTRACT

Systems and methods are provided for enhanced dryers for printing systems. One embodiment is an apparatus that includes a dryer for a continuous-forms printing system. The dryer includes heating elements located within an interior of the dryer that radiate infrared energy onto a web of printed media as the web travels through the interior, and an air knife that is interposed between the heating elements. The air knife includes a shell that directly absorbs infrared energy from the heating elements and also defines a passage for air to travel through the air knife onto the web. The shell directly absorbs infrared energy from each heating element that would otherwise overlap on the web with infrared energy from another heating element.

20 Claims, 10 Drawing Sheets

(56) References Cited

U.S. PATENT DOCUMENTS

| | | | | |
|---|---|---|---|---|
| 3,900,959 | A * | 8/1975 | Breschi | F26B 3/283 219/388 |
| 4,336,279 | A * | 6/1982 | Metzger | B29C 35/06 118/642 |
| 5,159,763 | A * | 11/1992 | Platsch | B41F 23/0413 34/267 |
| 5,440,821 | A * | 8/1995 | Hamrin | D21F 5/002 34/267 |
| 5,668,921 | A * | 9/1997 | Essler | F26B 3/283 392/379 |
| 6,439,712 | B1 | 8/2002 | Mizutani et al. | |
| 7,193,184 | B1 * | 3/2007 | Manning | A21B 1/245 219/388 |
| 7,966,743 | B2 * | 6/2011 | Piatt | B41J 11/002 118/715 |
| 8,469,505 | B2 | 6/2013 | Ohba et al. | |
| 8,684,510 | B2 | 4/2014 | Miyamoto et al. | |
| 8,746,871 | B2 | 6/2014 | Chiwata | |
| 8,807,736 | B1 | 8/2014 | Walker et al. | |
| 9,163,876 | B2 | 10/2015 | Chiwata et al. | |
| 9,283,772 | B2 | 3/2016 | Gellida et al. | |
| 2010/0221449 | A1 | 9/2010 | Schlallerbeck et al. | |
| 2010/0269366 | A1 * | 10/2010 | Kitamoto | F26B 3/283 34/274 |
| 2013/0194367 | A1 * | 8/2013 | Chiwata | B41J 11/0015 347/102 |
| 2015/0029277 | A1 | 1/2015 | Boland et al. | |
| 2015/0096452 | A1 * | 4/2015 | Puig Vil | B41F 9/003 101/152 |
| 2016/0152047 | A1 * | 6/2016 | Houjou | B41J 11/002 347/16 |
| 2016/0159111 | A1 | 6/2016 | Sasaki | |

FOREIGN PATENT DOCUMENTS

| | | | |
|---|---|---|---|
| EP | 0080448 | A2 | 6/1983 |
| JP | 54156536 | A | 12/1979 |
| JP | 11354487 | A | 12/1999 |
| KR | 100710886 | B1 | 4/2007 |

OTHER PUBLICATIONS

DE19929273 English Abstract.
JP11354487 English Abstract.
JPS54156536 English Abstract.
KR100710886 English Abstract.
European Search Report; Application 18153633.5-1014; dated Jul. 20, 2018.

* cited by examiner

INFRARED-HEATED AIR KNIVES FOR DRYERS

FIELD OF THE INVENTION

The invention relates to the field of printing, and in particular, to dryers for printing systems.

BACKGROUND

Dryers for printing systems may utilize infrared (IR) heating elements or actively blown air in order to directly heat a web of print media to a temperature at which ink ejected onto the web dries. Because the web proceeds quickly through the dryer, a careful balance must be achieved between underheating the web (resulting in applied ink not fully drying) and overheating the web (resulting in scorching of the ink and/or print media). These issues may be further complicated by the arrangement of various elements within the dryer.

Thus, designers of dryers for printing systems continue to seek out enhanced techniques for ensuring that inked webs of print media are fully dried, and without scorching. This ensures that print quality remains at a desired level.

SUMMARY

Embodiments described herein provide radiant dryers which include air knives that directly receive energy (e.g., IR energy) from internal heating elements that also radiate energy onto a web of print media. This results in the air knife increasing in temperature, causing air passing through the air knife to be heated by forced convective heat transfer with the air knife. The increase in air temperature increases the amount of moisture and ink vapor that may be drawn out of the web by the air.

One embodiment is an apparatus that includes a dryer for a continuous-forms printing system. The dryer includes heating elements located within an interior of the dryer that radiate infrared energy onto a web of printed media as the web travels through the interior, and an air knife that is interposed between the heating elements. The air knife includes a shell that directly absorbs infrared energy from the heating elements and also defines a passage for air to travel through the air knife onto the web. The shell directly absorbs infrared energy from each heating element that would otherwise overlap on the web with infrared energy from another heating element.

A further embodiment is an apparatus that includes multiple heating elements, and an air knife interposed between the heating elements. The air knife includes a shell having an exterior that directly absorbs infrared energy from the heating elements, a passage defined by the shell, and an inner surface of the shell heated by conductive heat transfer with the exterior the shell. Air exiting the air knife is heated by at least ten degrees Celsius via forced convective heat transfer with the shell.

A still further embodiment is a method that includes operating heating elements within an interior of a dryer to radiate infrared energy onto a web of printed media as the web travels through the interior, directly receiving infrared energy from the heating elements at a shell of an air knife, and heating air exiting a passage of the air knife by at least ten degrees Celsius via forced convective heat transfer with the shell.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
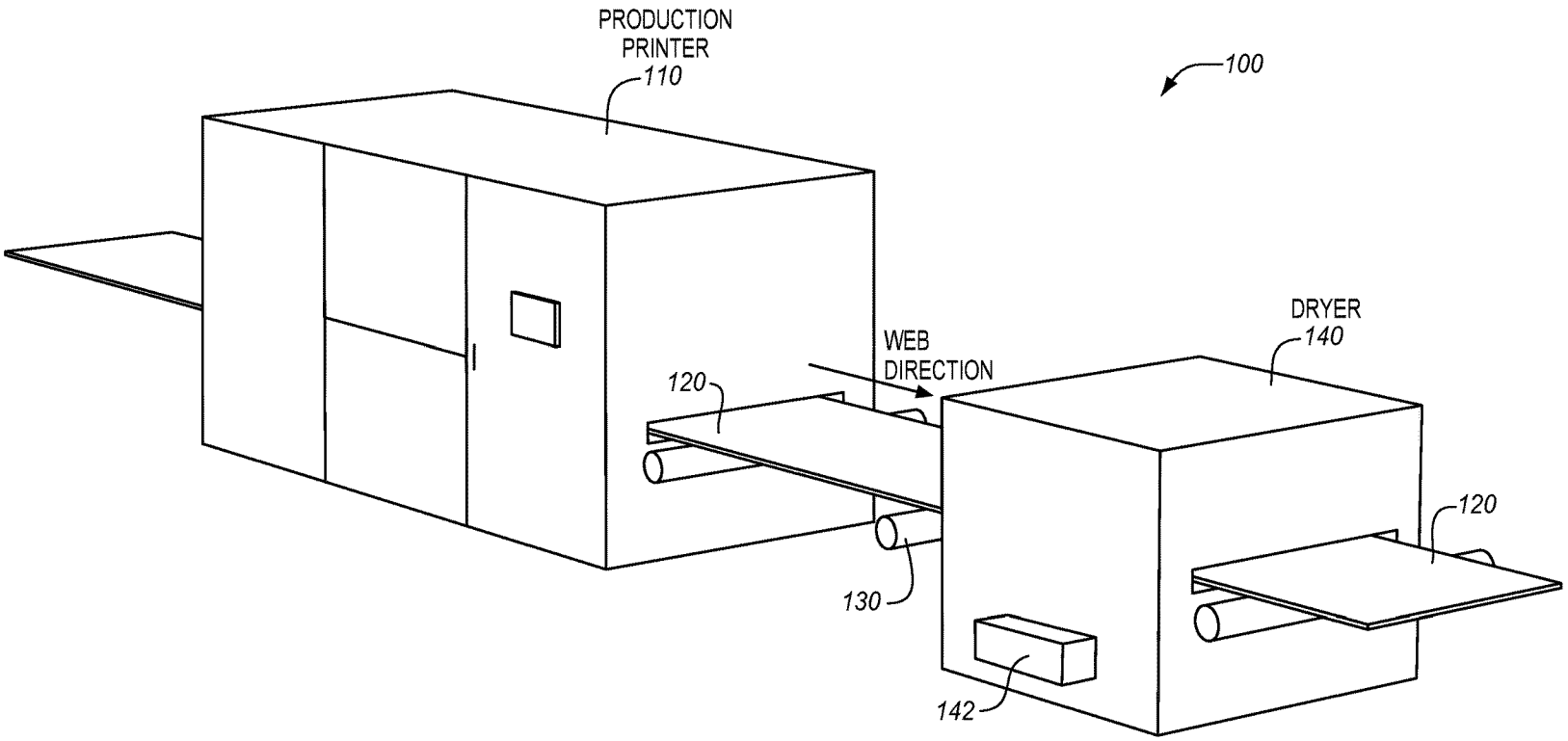
FIG. 1 is a diagram of a printing system in an exemplary embodiment.

FIG. 1 illustrates an exemplary continuous-forms printing system 100. Printing system 100 includes production printer 110, which is operable to apply ink onto a web 120 of continuous-forms print media. As used herein, the word "ink" is used to refer to any suitable marking fluid that can be applied by a printer onto web 120 (e.g., aqueous inks, oil-based paints, etc.). As used herein, the phrase "print media" (as in print media or printed media) refers to any substrate for receiving a marking fluid. Such substrates may include paper, coated paper, card stock, paper board, corrugated fiberboard, film, plastic, synthetics, textile, glass, tile, metal, leather, wood, composites, circuit boards or combinations thereof. Printer 110 may comprise an inkjet printer that applies colored inks, such as Cyan (C), Magenta (M), Yellow (Y), and Key (K) black inks. The ink applied by printer 110 to web 120 is wet, meaning that the ink may smear if it is not dried before further processing. One or more rollers 130 position web 120 as it travels through printing system 100.

To dry the ink, printing system 100 also includes dryer 140 (e.g., a radiant dryer). Dryer 140 can be installed in printer 110, or can be implemented as an independent device downstream from printer 110 (as shown in FIG. 1). Web 120 travels through dryer 140 where an array of heating elements such as IR heat lamps radiate thermal energy to dry the ink onto web 120. For example, web 120 may travel at a linear velocity of up to two hundred meters per minute through dryer 140. Controller 142 manages the operations of dryer 140 and/or printer 110. For example, controller 142 may manage various sensors, fans, heating elements, air logic, and other components at dryer 140. Controller 142 may be implemented as custom circuitry, as a hardware processor executing programmed instructions, etc.

However, drying ink onto web 120 is not a simple process. Some colors of ink are vulnerable to scorching if they are exposed to too much heat. For example, "K black" ink and other dark colors are generally more absorbent of IR energy than lighter colors. Because the darker colors absorb more IR energy from the heating elements, they can reach a higher temperature than other colors of ink while drying. This means that dark inks may dry completely and overheat to the point that they risk scorching before lighter inks have fully dried. This issue is particularly prevalent in regions within dryer 140 where radiant energy from different heating elements overlaps onto web 120. In order to address these concerns by reducing areas of radiative overlap while increasing the efficiency of an internal air knife, dryer 140 has been enhanced with a drying apparatus illustrated in FIGS. 2-6.

Figure 2:
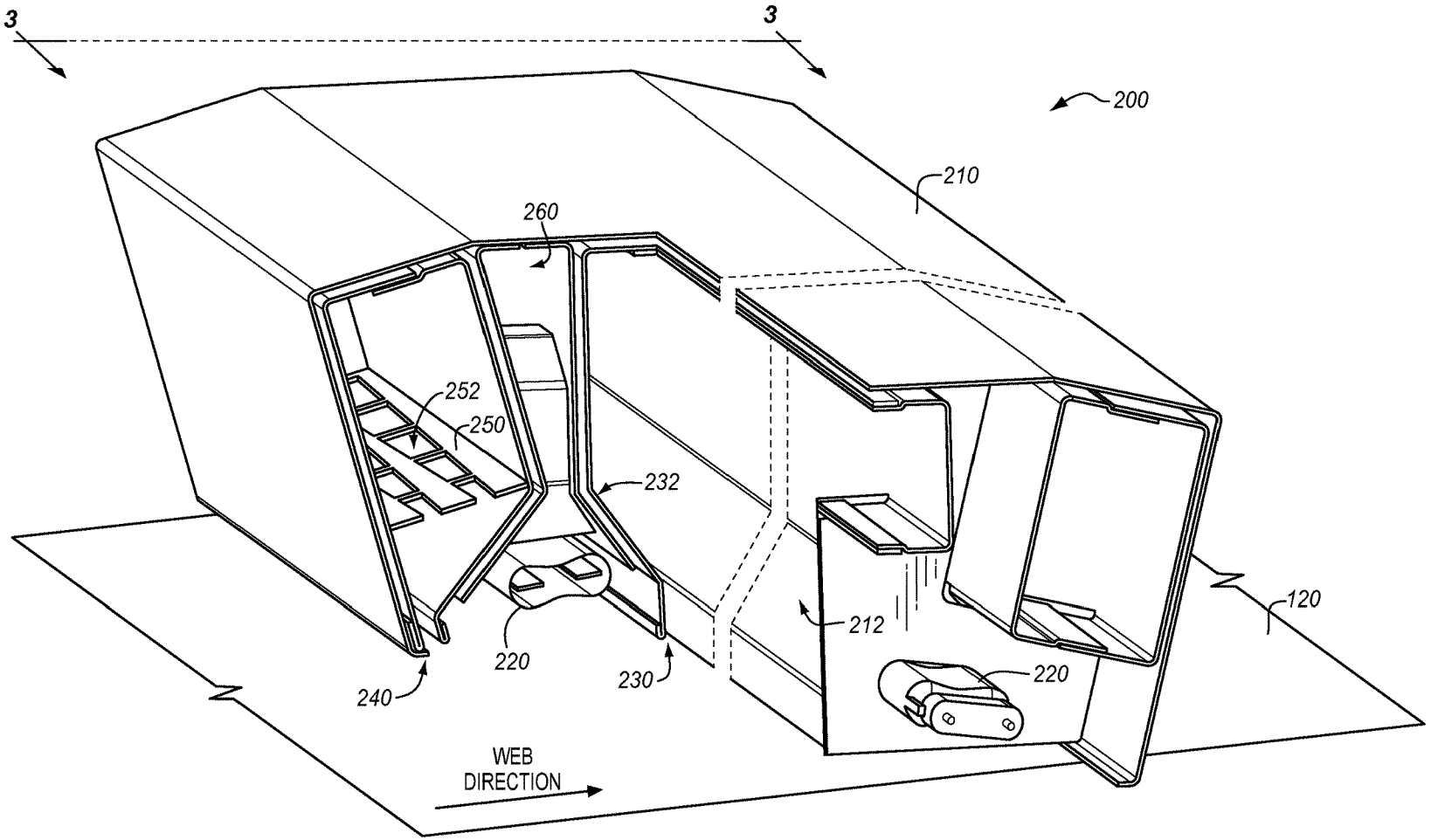
FIGS. 2-6 are diagrams of a drying apparatus of a printing system in an exemplary embodiment.
Figure 3:
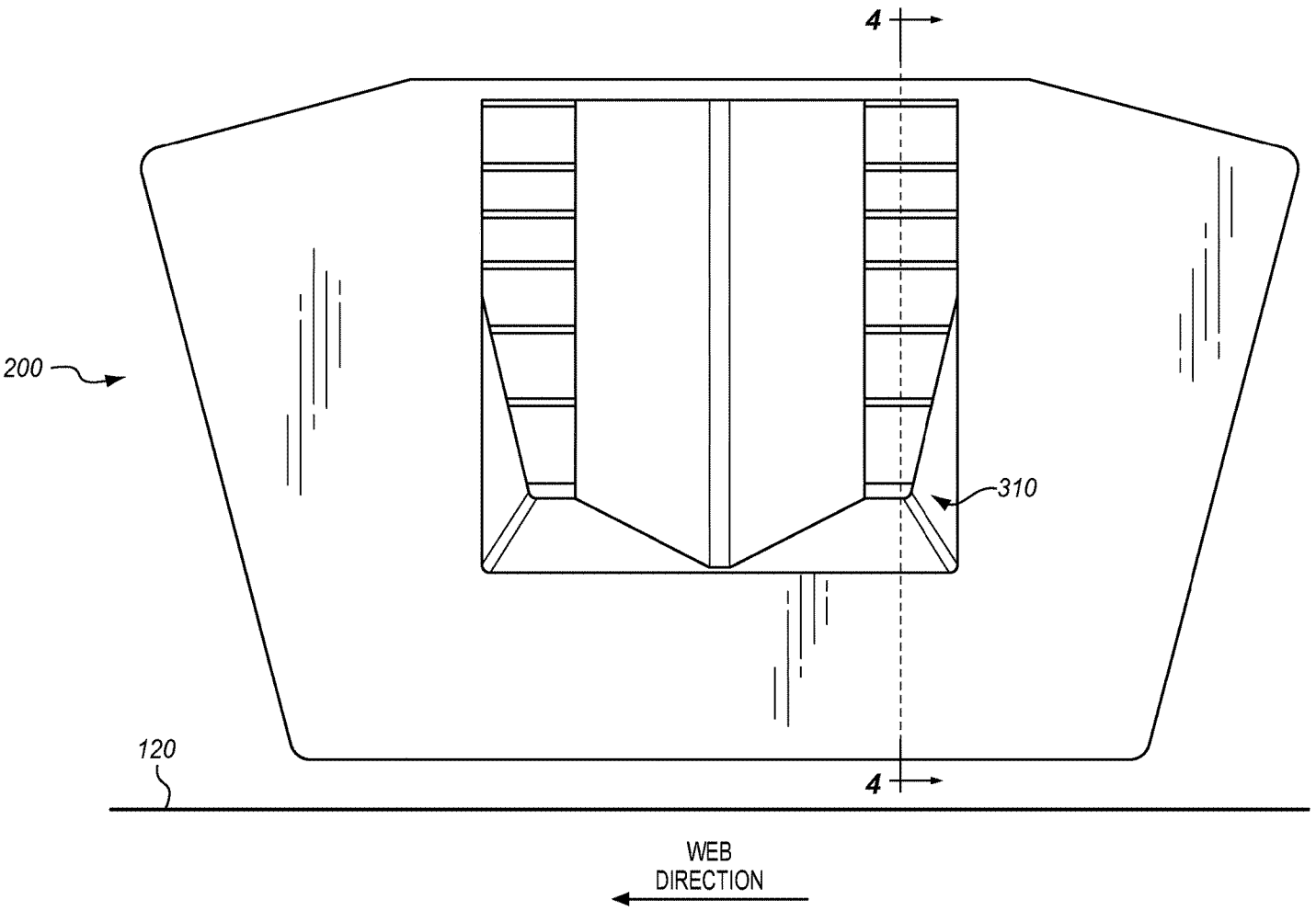
Figure 4:
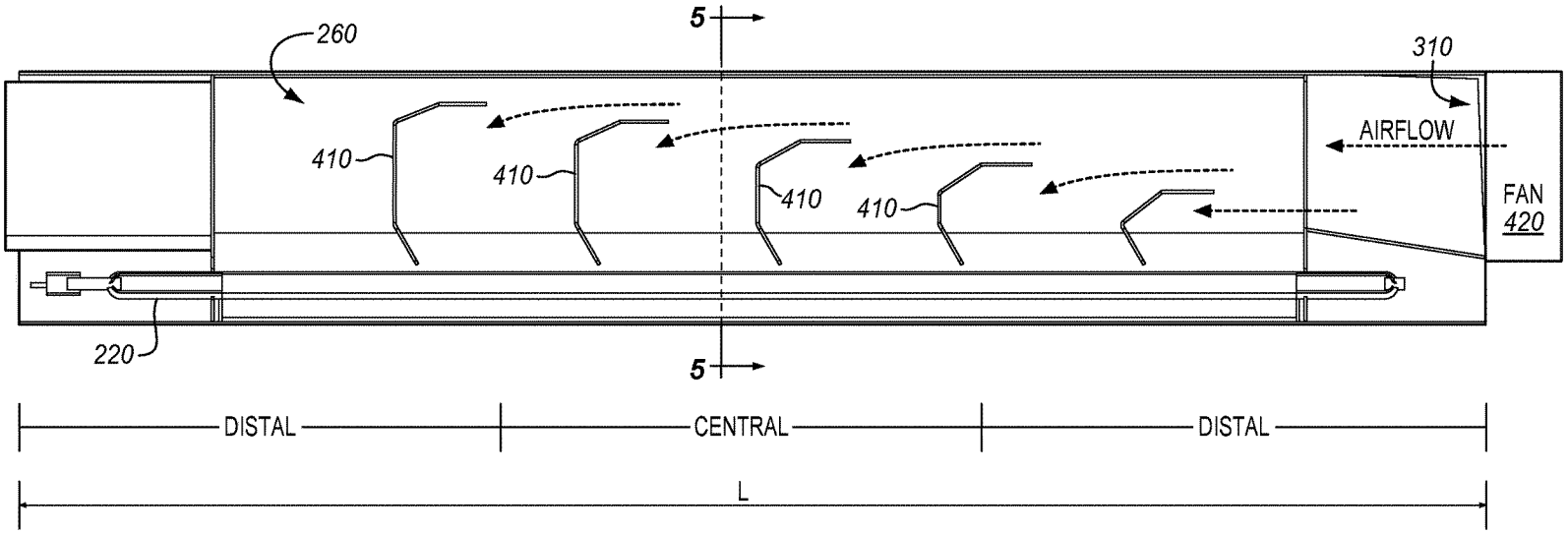
Figure 5:
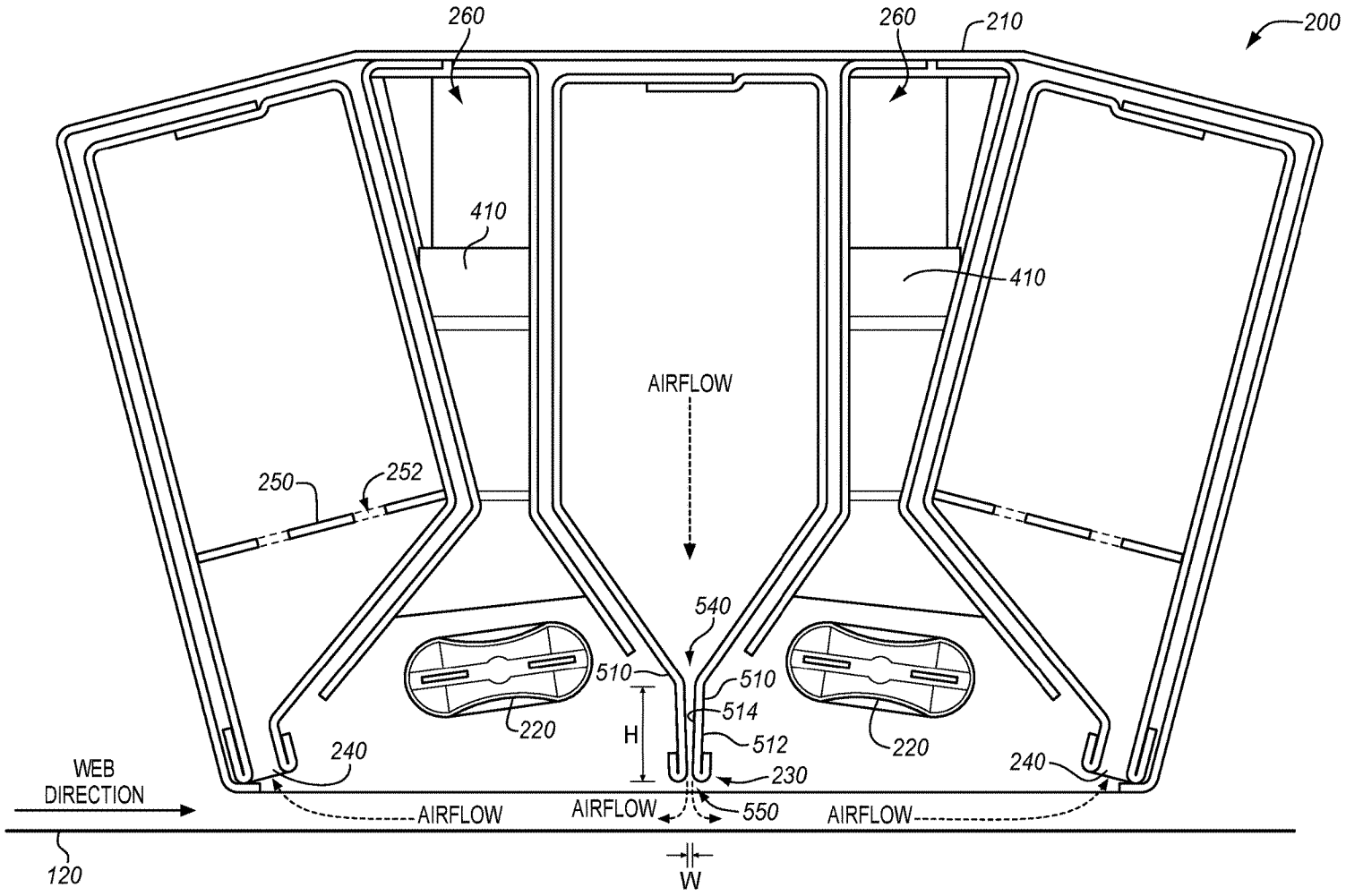
Figure 6:
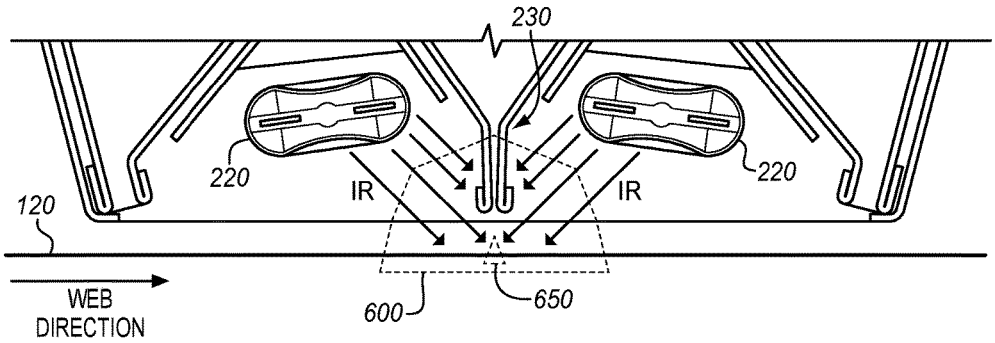

FIGS. 2-6 are diagrams of a drying apparatus 200 of dryer 140 in an exemplary embodiment. One or more of drying apparatus 200 may be utilized by dryer 140 to fully dry ink on web 120. FIG. 2 is a perspective view in which a left portion of dryer 140 has been subjected to a section cut. FIG. 3 is a front view of drying apparatus 200 indicated by view arrows 3 of FIG. 2, and uses the same section cut as in FIG. 2. FIG. 4 is a side view of drying apparatus 200 corresponding to view arrows 4 of FIG. 3. In FIG. 4, a section cut has been made to chamber 260 so as to illustrate internal features of chamber 260. Meanwhile, FIGS. 5-6 illustrate front section cut views of drying apparatus 200.

FIG. 2 illustrates that drying apparatus 200 includes housing 210, which surrounds various components of drying apparatus 200. These components within interior 212 of drying apparatus 200 include heating elements 220, which radiate IR energy onto web 120 as web 120 proceeds through dryer 140. In this embodiment, heating elements 220 may include cylindrical heat lamps that have a circular cross section. Such heat lamps may comprise tungsten halogen bulbs having filaments that are heated to 3300 Kelvin or be comprised of carbon based filament heated to temperatures of about 2000 Kelvin. As such, in some embodiments heating elements 220 may emit light/energy at a broad range of frequencies, including the near IR band (e.g., having wavelengths ranging from 1.1-1.4 microns) and/or mid IR band (e.g., having wavelengths ranging from 2.2-2.8 microns). Reflectors (not shown) may also be utilized to reflect energy generated by heating elements 220 back towards web 120, these reflective surfaces may also be integrated into the lamp housing. Heating elements 220 receive air from chambers 260, and this fresh air passing over heating elements 220 ensures that integrated reflective coatings do not get damaged from overheating due to air stagnation.

Interior 212 also includes air knife 230, which blows air onto web 120. Air knife 230 may be operated, for example, to blow air out of an outlet at a rate of up to sixty meters per second, at a distance of less than two centimeters (e.g., a distance of ten millimeters) from the surface of web 120. Incoming air for air knife 230 is thermally isolated from air for heating elements 220 by double wall 232. Return vent 240 is also illustrated in FIG. 2. Return vent 240 draws in air blown by air knife 230, in order to ensure that airflow remains restricted to interior 212 of drying apparatus 200. This helps to ensure that ink vapors within the air that result from the drying process do not exit drying apparatus 200 proximate to web 120. Return vents 240 include baffles 250 having slots 252 of varying sizes.

As shown in FIG. 2, the size of slots 252 is designed such that slot size decreases in locations with higher air velocity and increases in locations with lower air velocity. For example, slot size decreases as a baffle 250 proceeds away from an intake side (viewed in FIG. 3). This feature ensures that incoming airflow is evenly distributed along the length of return vent 240, as a majority of incoming airflow would otherwise be drawn to the exit portion of return vent 240 without having to substantially increase the size of the air plenum after the return vent 240. This allows for the overall size of the drying apparatus 200 to remain much smaller. Furthermore, depending on airflow rate and the width of web 120, the profiles of vent 240 and/or baffles 250 may change in order to account for one end of drying apparatus 200 drawing substantially more air than another end of drying apparatus 200. This helps to reduce and/or eliminate a stagnation point which would otherwise proceed to the outlet end.

FIG. 3 illustrates an intake 310 on the intake side, which may be utilized to supply air to a chamber 260 within drying apparatus 200. As shown in FIG. 4, airflow from a fan 420 may proceed from intake 310 into a chamber 260, where plates 410 operate to evenly distribute flow along the length (L) of chamber 260 onto a heating element 220. Although fan 420 is shown as integral with drying apparatus 200 in FIG. 3, in further embodiments fan 420 may be located separate from drying apparatus 200 via a duct (e.g., in order to avoid overheating the components of fan 420). In one embodiment, air provided to chamber 260 is sourced by a different air supply than the one which provisions air knife 230. This allows for air of different temperature and pressure to be provided to air knife 230 and heating elements 220. For example, hot air may be utilized by air knife 230, while ambient temperature air may be utilized to cool heating elements 220 such that reflector temperature is minimized and fans are able to supply air to heating elements 220 without overheating.

FIGS. 5-6 illustrate additional features of air knife 230 and return vents 240. Specifically, FIG. 5 illustrates that air knife 230 includes an outlet 550 (e.g., an exit nozzle), which is defined by shell 510. Shell 510 includes exterior 512, along with an inner surface 514. Inner surface 514 is heated by conductive heat transfer with exterior 512. Shell 510 further defines passage 540, through which air flows out of air knife 230. The height (H) and width (W) of passage 540 are selected to ensure that a majority of air (or all air) flowing through passage 540 experiences forced convective heat transfer with inner surface 514. For example, H may be chosen to extend to within one centimeter of web 120, while W may be chosen based on a desired ratio of H to W (e.g., five to one) that ensures adequate heat transfer to air flowing through passage 540. In one example, W is 1.5 millimeters. Furthermore, the thickness, thermal conductivity, and strength properties of shell 510 are chosen to ensure that radiant heat from heating elements 220 transfers readily from exterior 512 to inner surface 514, as well as to ensure that shell 510 maintains structural integrity and uniformity of slot width even when heated to temperatures in excess of 250° C. For example, shell 510 may be made from a material having a thermal conductivity of at least twenty Watts per meter Kelvin, thermal expansion coefficient less than 40 microns per meter-Kelvin, and an ultimate tensile strength greater than 200 Megapascals (MPa). One example of such a material is stainless steel. In such an example, a distance between exterior 512 and inner surface 514 (i.e. a thickness of shell 510) may be chosen to be less than two millimeters in order to ensure rapid conduction of heat from exterior 512 to inner surface 514.

FIG. 6 illustrates how the size of a region of overlap between heating elements 220 may be reduced or even eliminated by air knife 230. Without air knife 230 being interposed between heating elements 220, infrared energy from heating elements 220 would overlap onto web 120 within region 600. However, with air knife 230 placed between heating elements 220, the overlap may be reduced to region 650, or may even be eliminated entirely. This reduces the chances of scorching at web 120, while allowing for heating elements 220 to be positioned at a higher frequency in the paper feed direction (i.e., in series along the web direction), decreasing the overall drying web length or improving drying for a given area.

In further embodiments, heating elements 220 and multiple air knives 230 may be utilized in series, such that return air from the air knives 230 remains contained within one drying apparatus/assembly. This enhances the efficiency of the drying process in order to increase the overall drying power of a drying apparatus.

The particular arrangement, number, and configuration of components described herein is exemplary and non-limiting. Illustrative details of the operation of drying apparatus 200 and dryer 140 will be discussed with regard to FIG. 7. Assume, for this embodiment, that printer 110 has completed marking web 120 with ink, and that web 120 is being actively driven through dryer 140 in order to dry the ink onto web 120. In one embodiment, the process includes measurement of output web temperature, and varying power output by heating elements 220 based on this output web temperature. This may further involve measuring outlet air temperature at air knife 230 to control power at heating element 220 and velocity of airflow. In one embodiment, power for heating elements 220 and airflow velocity from air knife 230 are both dynamically controlled based on web velocity.

Figure 7:
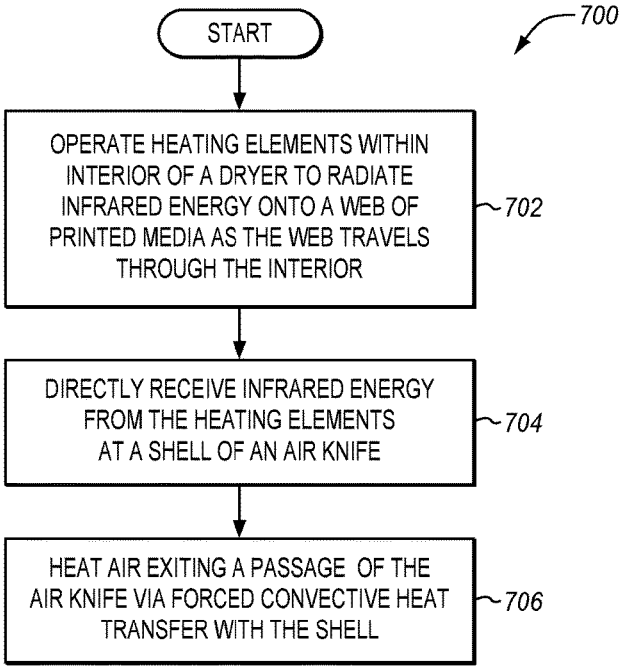
FIG. 7 is a flowchart illustrating a method for operating a dryer of a printing system in an exemplary embodiment.

FIG. 7 is a flowchart illustrating a method 700 for operating a dryer in an exemplary embodiment. The steps of method 700 are described with reference to printing system 100 of FIG. 1, but those skilled in the art will appreciate that method 700 may be performed in other systems. The steps of the flowcharts described herein are not all inclusive and may include other steps not shown. The steps described herein may also be performed in an alternative order.

According to method 700 drying apparatus 200 operates heating elements 220 within interior 212 of dryer 140 to radiate infrared energy onto web 120 as web 120 travels through interior 212 (step 702). This serves to heat web 120 and remove moisture from ink on web 120. Exterior 512 of shell 510 of air knife 230 directly receives and absorbs infrared energy radiated by heating elements 220 (step 704). This energy is transferred via conduction to inner surface 514. Thus, as air is forced through air knife 230, a majority of air exiting passage 540 is heated by at least 10° Celsius via forced convective heat transfer with inner surface 514 of shell 510 (step 706). Furthermore, air within air knife 230 may be heated above ambient temperature (e.g., 20° Celsius) exclusively by this forced convective heat transfer with inner surface 514.

This technique for heating air traveling out of air knife 230 provides multiple benefits. First, this ensures that air knife 230 provides heated air (e.g., air heated from ambient temperature to 50-150° Celsius) to web 120. Hotter air has an increased capacity to carry moisture and ink vapors off of web 120, and therefore increases the efficiency of the drying process. Second, method 700 eliminates the need for an independent heating apparatus for air within air knife 230, which reduces the need for maintenance at drying apparatus 200, as well as reducing the number of potential points of failure at drying apparatus 200. Method 700 also uses more of the distribution of heat from IR lamps to improve the drying process, instead of allowing heat to be absorbed by nonfunctional drying components such as metal. This has the additional benefit of providing a user safety from stray light or hot surfaces.

Figure 8:
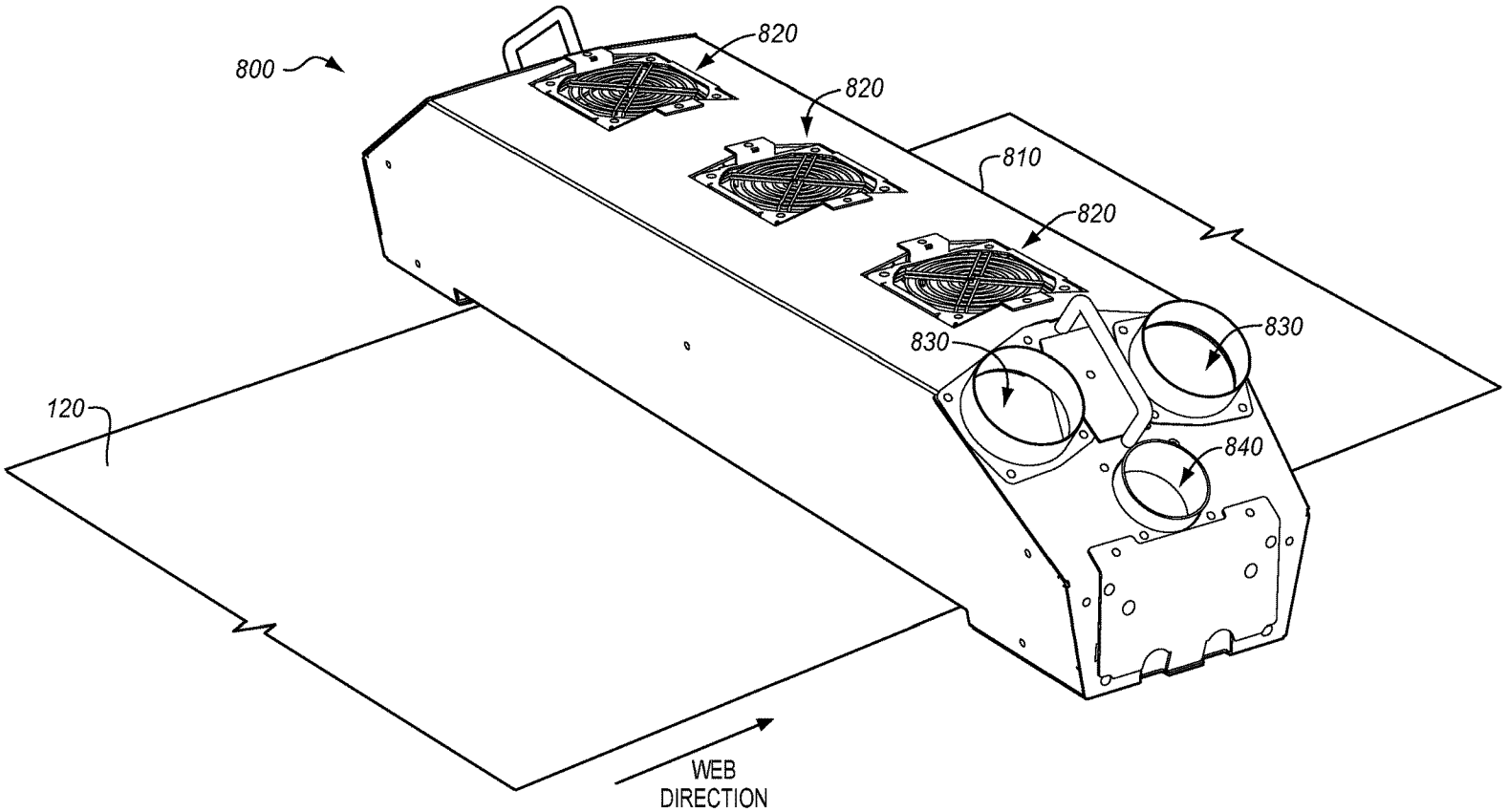
FIG. 8 is a diagram illustrating a further drying apparatus of a printing system in an exemplary embodiment.
Figure 9:
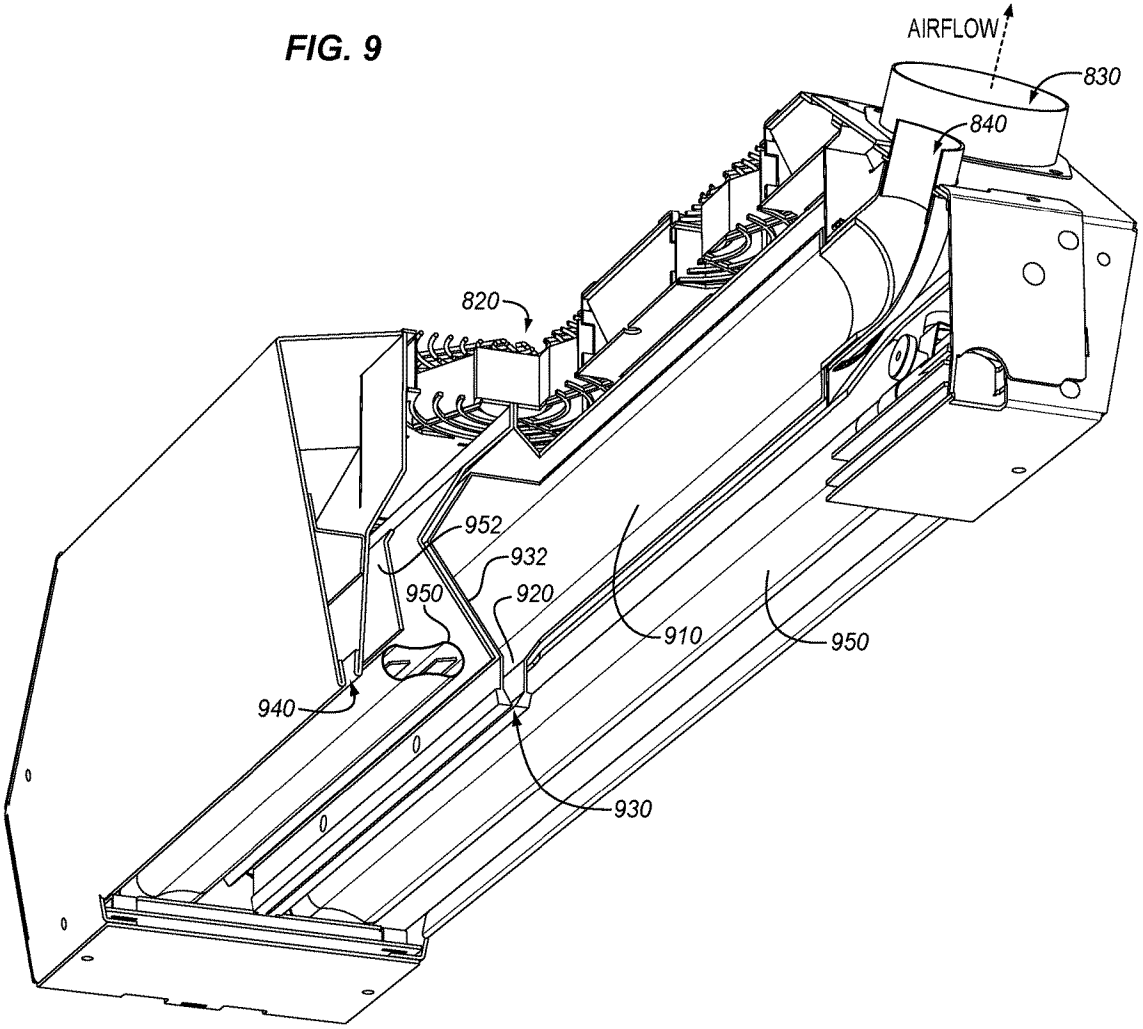
FIG. 9 is a section cut diagram of the drying apparatus of FIG. 8 in an exemplary embodiment.
Figure 10:
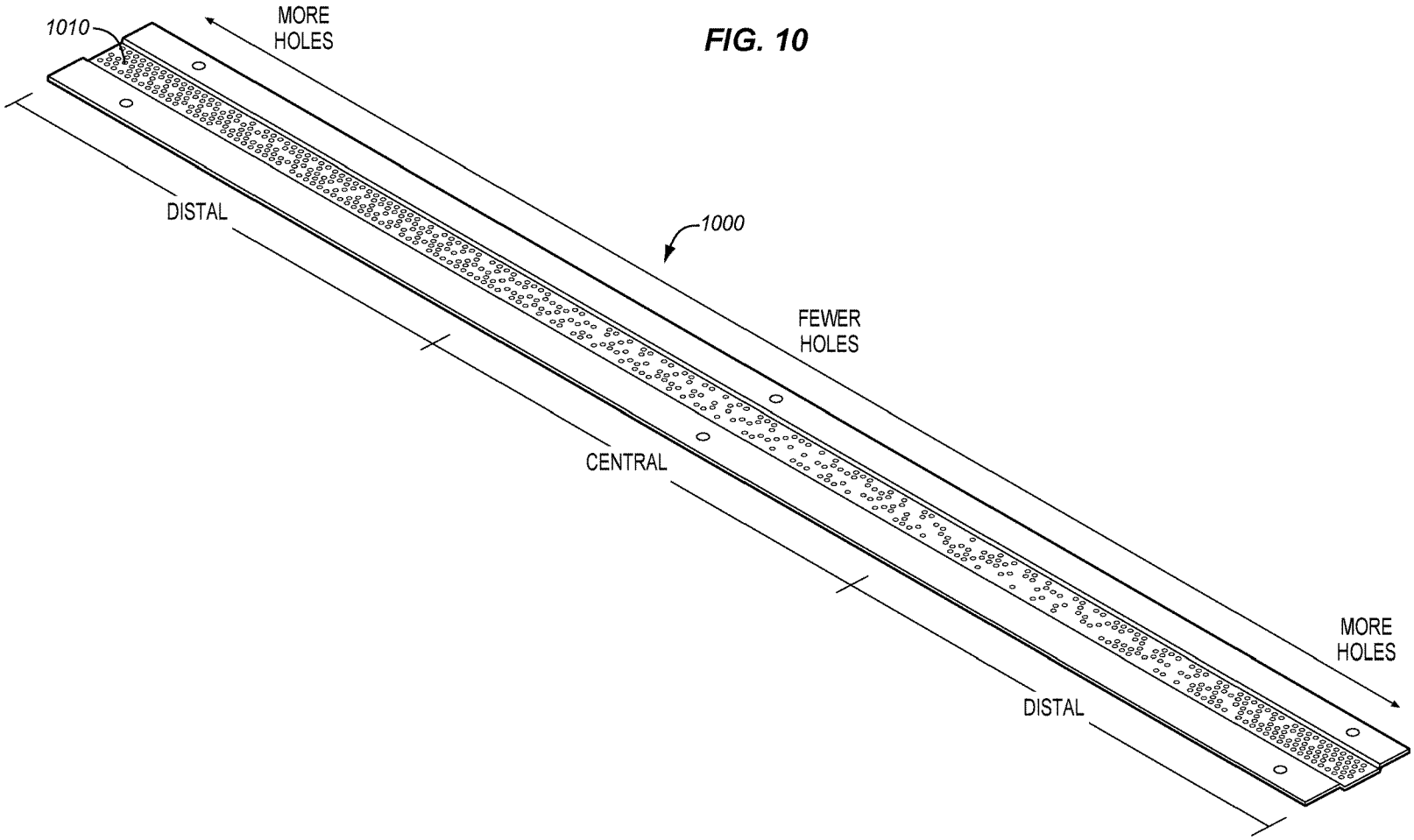
FIG. 10 illustrates a vent plate for a return vent of the drying apparatus of FIG. 8 in an exemplary embodiment.

FIGS. 8-10 illustrate an alternate embodiment of a drying apparatus 800 for dryer 140 of FIG. 1. Specifically, FIG. 8 is a diagram illustrating a further drying apparatus of a printing system in an exemplary embodiment. As shown in FIG. 8, drying apparatus 800 includes housing 810, which includes fans 820, as well as ducts 830 and duct 840. FIG. 9 is a section cut diagram of drying apparatus 800, and illustrates that fans 820 provide airflow over heating elements 950, while duct 840 provides airflow for air knife 930. Airflow travels through shell 920 before exiting air knife 930. A return vent 940 is also illustrated, which is coupled with a corresponding return duct 830 in order to draw moist air out of drying apparatus 800. In this embodiment, air provided by fans 820 comes from a separate supply (not shown). Thus, the air provided by fans 820 is cooler than air used for air knife 930. This is to ensure that a reflector 952 may be adequately cooled. In order to ensure that air flowing through air knife 930 is properly heated, walls 932 for air knife 930 are double-walled to reduce heat loss with the cooled air, while shell 920 remains single walled, as the application of energy from heating elements 950 will ensure that shell 920 remains at a desired temperature. In further embodiments, it may be desirable to implement fans 820 as temperature-resistant fans capable of experiencing substantial amounts of heat without failing.

FIG. 10 illustrates a vent plate 1000 for a return vent 940 of the drying apparatus of FIG. 8 in an exemplary embodiment. Vent plate 1000 serves a similar purpose to that of baffles 250 of FIG. 2. That is, vent plate 1000 is designed to ensure that airflow is received evenly along the length of return vent 940. To this end, a variable pattern of holes 1010 has been applied to vent plate 1000. The variable pattern is designed such that there are fewer holes in locations with higher air velocity and more holes in locations with lower air velocity. For example, distal portions of vent plate 1000 towards an intake side have a larger number of holes 1010 per unit area. In this embodiment, holes 1010 are equally sized. In this manner, the resistance to airflow at vent plate 1000 varies as a function of length, in order to account for imbalanced airflow that would otherwise result at an "open" return vent 940. Furthermore, this embodiment illustrates that the smallest amount of holes per unit area is offset from the center of vent plate 1000 towards the right. This design feature may be utilized in order to account for stagnation points that may otherwise result from a sharp corner at drying apparatus 800. The number of holes per unit area in vent plate 1000 may be defined based, for example, on a combination of quadratic and linear functions.

Figure 11:
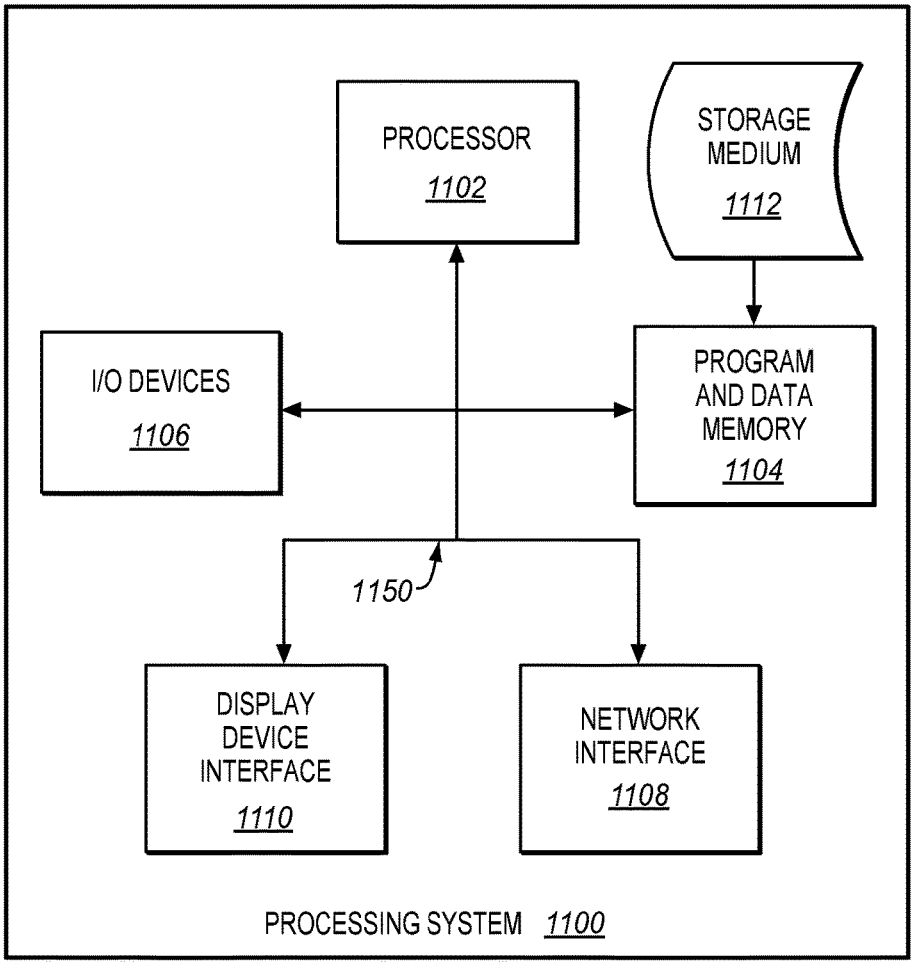
FIG. 11 illustrates a processing system operable to execute a computer readable medium embodying programmed instructions to perform desired functions in an exemplary embodiment.

Embodiments disclosed herein include control devices that implement software, hardware, firmware, or various combinations thereof. In one particular embodiment, software is used to direct a processing system of dryer 140 to perform the various operations disclosed herein (e.g., related to operating various heating elements, fans, drive systems for a web, etc.). FIG. 11 illustrates a processing system 1100 operable to execute a computer readable medium embodying programmed instructions to perform desired functions in an exemplary embodiment. Processing system 1100 is operable to perform the above operations by executing programmed instructions tangibly embodied on computer readable storage medium 1112. In this regard, embodiments of the invention can take the form of a computer program accessible via computer-readable medium 1112 providing program code for use by a computer or any other instruction execution system. For the purposes of this description, computer readable storage medium 1112 can be anything that can contain or store the program for use by the computer.

Computer readable storage medium 1112 can be an electronic, magnetic, optical, electromagnetic, infrared, or semiconductor device. Examples of computer readable storage medium 1112 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 1100, being suitable for storing and/or executing the program code, includes at least one processor 1102 coupled to program and data memory 1104 through a system bus 1150. Program and data memory 1104 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 1106 (including but not limited to keyboards, displays, pointing devices, sensors, fans, motors, etc.) can be coupled either directly or through intervening I/O controllers. Network adapter interfaces 1108 may also be integrated with the system to enable processing system 1100 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 1110 may be integrated with the system to interface to one or more display devices, such as printing systems and screens for presentation of data generated by processor 1102.

Although specific embodiments were described herein, the scope of the invention is not limited to those specific embodiments. The scope of the invention is defined by the following claims and any equivalents thereof.

We claim:

1. An apparatus comprising:

a dryer for a continuous-forms printing system, the dryer comprising:

heating elements located within an interior of the dryer that radiate infrared energy onto a web of printed media as the web travels through the interior; and an air knife that is interposed between the heating elements, the air knife comprising a shell that directly absorbs infrared energy from the heating elements and also defines a passage for air to travel through the air knife onto the web, wherein the shell directly absorbs infrared energy from each heating element that would otherwise overlap on the web with infrared energy from another heating element.

2. The apparatus of claim 1 wherein:

the shell directly prevents the formation of a region where infrared energy from multiple heating elements overlaps on the web.

3. The apparatus of claim 1 wherein:

air exiting the air knife is heated by at least ten degrees Celsius via convective heat transfer with an inner surface of the shell.

4. The apparatus of claim 1 wherein:

air exiting the air knife is heated above ambient temperature exclusively by forced convective heat transfer with an inner surface of the shell.

5. The apparatus of claim 1 wherein:

the shell defines an exit nozzle of the air knife.

6. The apparatus of claim 1 further comprising:

a return vent that draws air out of the dryer.

7. The apparatus of claim 6 wherein:

the return vent includes a baffle having slots of varying sizes along a length of the baffle, such that the slot size decreases in locations with higher air velocity and increases in locations with lower air velocity.

8. The apparatus of claim 6 wherein:

the return vent includes a vent plate which includes a varying pattern of holes along its length, such that the vent plate has fewer holes in locations with higher air velocity and more holes in locations with lower air velocity.

9. The apparatus of claim 6 wherein:

the dryer includes multiple return vents; and each heating element is located between a return vent and the air knife.

10. The apparatus of claim 1 further comprising:

a fan that blows air across one or more of the heating elements.

11. An apparatus comprising:

multiple heating elements; and an air knife interposed between the heating elements, the air knife comprising:

a shell comprising an exterior that directly absorbs infrared energy from the heating elements;

a passage defined by the shell; and an inner surface of the shell heated by conductive heat transfer with the exterior the shell, wherein air exiting the air knife is heated by at least ten degrees Celsius via forced convective heat transfer with the shell.

12. The apparatus of claim 11 wherein:

the shell absorbs infrared energy from each heating element that would otherwise intersect with infrared energy from another heating element.

13. The apparatus of claim 11 wherein:

the shell reduces a size of a region in which infrared energy from the heating elements intersects.

14. The apparatus of claim 11 wherein:

air exiting the air knife is heated above ambient temperature exclusively by forced convective heat transfer with the inner surface of the shell.

15. The apparatus of claim 11 wherein:

the shell defines an exit nozzle of the air knife.

16. The apparatus of claim 11 wherein:

a distance between the exterior of the shell and the inner surface of the shell is less than two millimeters.

17. The apparatus of claim 11 wherein:

the shell comprises a material having a thermal conductivity of at least twenty Watts per meter Kelvin.

18. A method comprising:

operating heating elements within an interior of a dryer to radiate infrared energy onto a web of printed media as the web travels through the interior;

directly receiving infrared energy from the heating elements at a shell of an air knife; and heating air exiting a passage of the air knife by at least ten degrees Celsius via forced convective heat transfer with the shell.

19. The method of claim 18 wherein:

directly receiving infrared energy from the heating elements at the shell absorbs infrared energy from each heating element that would otherwise overlap on the web with infrared energy from another heating element.

20. The method of claim 18 wherein:

directly receiving infrared energy from the heating elements at the shell reduces a size of a region in which infrared energy from the heating elements overlaps on the web.

* * * * *